United States Patent [19]

Gagnebin

[11] Patent Number: 4,928,359

[45] Date of Patent: May 29, 1990

[54] EXTENDABLE BRACELET CLASP WITH FINE ADJUSTMENT

[75] Inventor: Gaston Gagnebin, Bienne, Switzerland

[73] Assignee: Omega SA, Bienne, Switzerland

[21] Appl. No.: 379,814

[22] Filed: Jul. 14, 1989

[30] Foreign Application Priority Data

Jul. 15, 1988 [FR] France ..... 88 09716

[51] Int. Cl.[5] ..... A44C 5/24

[52] U.S. Cl. ..... 24/71 J; 24/583

[58] Field of Search ..... 24/71 J, 71 R, 71 SK, 24/68 J, 580, 582, 583, 586, 658, 683, 265 WS

[56] References Cited

U.S. PATENT DOCUMENTS

| | | |
|---|---|---|
| 2,110,772 | 3/1938 | Myrberg et al. . |
| 3,863,299 | 2/1975 | Hocq . |
| 3,913,182 | 10/1975 | Fontana . |
| 4,324,024 | 4/1982 | Fontana . |
| 4,545,094 | 10/1985 | Fontana . |

FOREIGN PATENT DOCUMENTS

| | | | |
|---|---|---|---|
| 3520122 | 1/1986 | Fed. Rep. of Germany . | |
| 352175 | 3/1961 | Switzerland . | |
| 553553 | 9/1974 | Switzerland . | |
| 657763 | 9/1986 | Switzerland . | |
| 8692 | 6/1901 | United Kingdom | 24/583 |

*Primary Examiner*—James R. Brittain

*Attorney, Agent, or Firm*—Griffin, Branigan & Butler

[57] ABSTRACT

The clasp of this invention include a first element (1) bearing a hook (4) and a second element (6) under which is arranged a catch (9). The second element is provided with an opening (8) giving access to two identical holes (11, 17) arranged side by side in the longitudinal direction of the bracelet. The hook may be latched as desired by the first (11) or the second (17) hole is accordance with whether one wishes the bracelet to be tight or looser around the wrist. In closed position the beak (5) of the hook will be located under the catch. In order to open the clasp one presses the push button (10) which forms an integral part of the catch. Such clasp may be employed for a wrist watch.

5 Claims, 2 Drawing Sheets

EXTENDABLE BRACELET CLASP WITH FINE ADJUSTMENT

This invention concerns a bracelet clasp including a first element attached to one end of the bracelet and a second element attached to the other end of the bracelet, the first and second elements cooperating to assure latching of the clasp by superposition of said elements, the first element bearing a hook provided with a beak directed perpendicular to the longitudinal direction of the bracelet and the second element being pierced with at least one opening in which the hook may be introduced, a catch being captively mounted under the second element and slidable relative thereto, the catch exhibiting a portion emerging laterally from said second element under the return force of a spring, said portion serving as a push button adapted to be operated by a finger so as to displace the catch against the spring action, said catch being provided with a first hole partially set off relative to the opening in the second element so that when the hook is introduced into the opening of the second element it then engages with said first hole of the catch so as to displace said catch gradually against the action of the spring until the beak of the hook passes through the catch and latches the first element of the second element, said catch being displacable by finger pressure on the push button so as to align said opening with said first hole thus to permit opening of the clasp.

BACKGROUND OF THE INVENTION

A clasp corresponding to the generic definition which has just been given is described in the Swiss patent document CH-A-568 035 (=U.S.-A-No. 3,913,182). This clasp, developed in particular for a watch bracket, includes two rigid elements fixed to the free ends of the bracelet. One of the elements includes a hook which may be inserted through an opening presented by the other element. Such other element includes a catch arranged to latch the hook when the elements are pressed against one another. The catch includes a push button emerging from the other element which when it is pressed by a finger enables unlatching the elements and opening the clasp.

A clasp showing much analogy with that just described hereinabove is described in the German patent document DE-A-35 20 122. In addition to the latching system employing a hook and a catch arranged as described hereinabove, the clasp offers the possibility of being extended beyond the simple extension provided by the opening of two blades articulated on one another, and this in view of the fact that one of the blades is mounted to slide in a stirrup itself mounted on a hinge on the other blade.

The Swiss patent document CH-A-553 553 describes a clasp enabling the shortening or lengthening of a bracelet. To this end it is provided with a movable plate sliding under a fixed plate, each of the plates being provided with holes superposed in pairs. In one pair of holes there may penetrate a hook, the beak of which is arranged in the longitudinal direction of the bracelet. In order to open the clasp, one presses on a push button in the longitudinal sense of the bracelet. This arrangement is not in any way adapted to the clasp of the present invention. Moreover, the construction does not provide a fine adjustement, but a coarse adjustment extending at least over the width of a link.

However, none of the cited documents offers the possibility of shortening or extending slightly the length of the bracelet in order to permit wearing the bracelet tightly or loosely around the arm which bears it. Nevertheless, it has been determined that one frequently experiences the need to proceed with such an adjustment since the dimensions of the arm change according to whether the external temperature is low or high. With no possibility of regulation, the bracelet may squeeze the wrist at high temperatures during summer time. On the other hand, during winter, the same bracelet is free around the wrist and if it is employed to attach a watch, the latter may assume undesired positions, for example under the wrist. It has likewise been determined that the differences between the dimensions of a swollen or contracted wrist of the same person is less than the usual width of the links making up the bracelet. From this it is evident that adding or removing a normal link from the bracelet is not entirely satisfactory. Some manufacturers propose half links to overcome such difficulty, however this solution is unsatisfactory from the point of view of the appearance as well as being expensive and difficult to practise by the wearer of the bracelet.

SUMMARY OF THE INVENTION

To overcome the difficulties as cited hereinabove, the present invention proposes a clasp which permits easy adaptatiion of a bracelet to the member which bears it. In order to accomplish this, the clasp which corresponds to the generic definition given at the beginning of this description is characterized in that the catch is equipped with a second hole identical with the first and arranged beside the latter in the sense of the longitudinal direction of the bracelet, the hook then being introduced in the first or the second hole according to whether one desires a tight or loose bracelet wound around the member which bears it.

The invention will now be set forth in the description to follow in referring to the drawings which illustrate it by way of example.

DESCRIPTION OF THE PREFERRED EMBODIMENT

Figure 1:
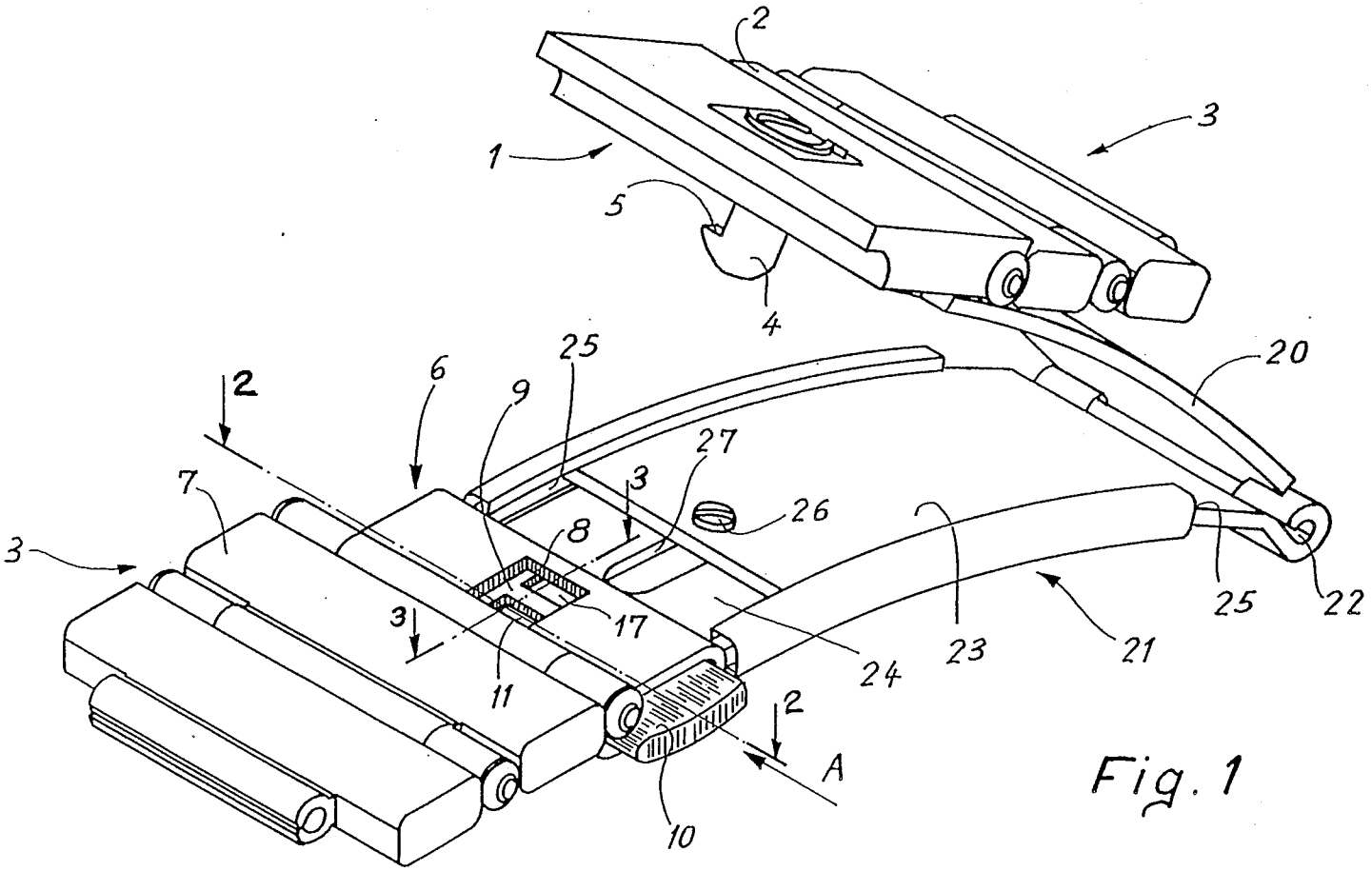
FIG. 1 is a perspective view of the clasp in accordance with the invention.

FIG. 1 is a perspective view to an enlarged scale of the bracelet clasp according to the invention. Such clasp includes a first element 1 attached to one of the ends 2 of the bracelet 3. This first element 1 bears a hook 4 provided with a beak 5, said beak being directed perpendicularly to the longitudinal direction of the bracelet. The clasp further includes a second element 6 attached to the other end 7 of the bracelet 3. This second element 6 is pierced with at least one opening 8 in which the hook 4 may penetrate. Under the second element 6 is mounted a catch 9. This catch is slidingly mounted under element 6 and is captively retained by means which will be discussed hereinafter. The catch 9 exhibits furthermore a portion 10 which emerges laterally from the second element under the action of a return spring 12, not shown here, but which appears on FIGS. 2*a* to 2*c*. This portion 10 serves as a push button which is adapted to be operated by a finger in the sense of arrow A, in order to displace the catch against the action of the spring. The catch is also provided with a first hole 11. As shown clearly on FIG. 1 and FIG. 2*a* (which is a cross-section according to line II—II of FIG. 1), the first hole 11 is partially offset relative to the opening 8 provided in the second element 6.

Figure 2A:
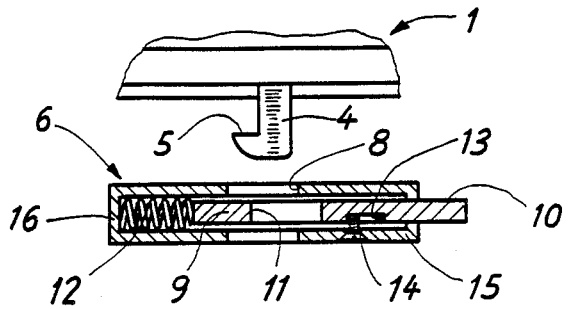
FIGS. 2*a*, 2*b* and 2*c* show a cross-section along the line II—II of FIG. 1 in three different situations according to the position of the hook relative to the element to which it is latched.
Figure 2B:
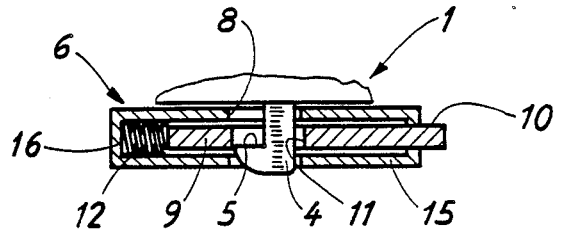
Figure 2C:
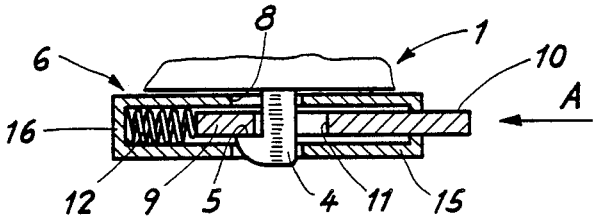

FIGS. 2*a* to 2*c* describe the operation of the clasp such as is known from the prior art contained in the cited documents. FIG. 2*a* shows the clasp in an open state, such as is also clear from FIG. 1. Here the catch 9 is pushed towards the exterior of element 6 by the action of compression spring 12. FIG. 2*b* shows that the hook 4 of element 1 has been introduced into opening 8 of element 6 and that in view of the rounded portion situated under beak 5, it has displaced the catch 9 towards the left against the action of spring 12 which at this point almost entirely compressed. In terminating the introduction of hook 4 into the opening 8 and hole 11, one will find the situation shown by FIG. 2*c* where beak 5 of the hook is located under the catch 9 in a manner such that the element 1 is latched to the element 6, the catch thereupon taking up the position which it had in FIG. 2*a* by the return action of spring 12. In order to open the clasp 11, it will suffice then to press catch 9 via the push button 10 with a finger in accordance with the arrow A, in order to return to the situation of FIG. 2*b* in which position the element 1 may be separated from element 6.

Two comments may be made here concerning the details of the mechanism as described.

The first comment concerns the catch 9 which must be provided with means preventing it from escaping from element 6. FIG. 2*a* shows a possible means to arrive at this objective. One may provide in the catch a groove 13 slightly longer than the length of the travel necessary for the catch to fulfil its purpose. One may piece a screw 14 in the lower wall 15 completing element 6, the end of the screw 14 then plunging into groove 13.

The second comment concerns the manner in which catch 9 is slidingly retained captive under element 6. In all the figures shown, the element 6 including opening 8 forms part of a tube including among other elements a lower wall 15 and a closure 16 at one end of the ends of the tube. The catch is then slidingly mounted and likewise captive in such tube. One may however imagine other arrangements. One such for instance might consist of providing under element 6 two slideways in dovetail form, such slideways receiving the catch itself provided with lateral edges matching the form of the slideways in order to maintain said catch slidingly captive under element 6.

Figure 3A:
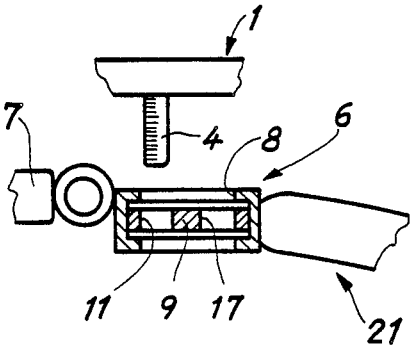
FIG. 3*a* is a cross-section according to line III—III of FIG. 1.
Figure 3B:
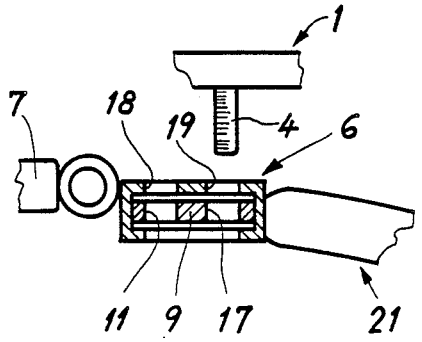
FIG. 3*b* is a cross-section along line III—III of FIG. 1 in accordance with a different embodiment from that of FIG. 3*a*.

According to an essential feature of the invention and as visible on FIG. 1 and on FIGS. 3*a* and 3*b* which are cross-sections along line III—III of FIG. 1, catch 9 is provided with a second hole 17 identical to the first hole 11 and arranged beside the latter in the sense of the longitudinal direction of the bracelet. Thus, hook 4 may be introduced into the first hole 11 (FIG. 3*a*) or the second hole 17 (FIG. 3*b*) according to whether the bracelet is desired to embrace the wrist tightly or loosely. One sees that holes 11 and 17 are relatively close to one another, this generally compensating the increase in the perimeter of the wrist during hot weather. During hot weather one may introduce the hook into hole 17 and during cold weather into hole 11. One is thus assured of a ready matching of the bracelet under all circumstances.

FIG. 3*a* shows that the opening 8 is unique and that it gives access at the same time to both holes 11 and 17 borne by catch 9. FIG. 3*b* shows a different embodiment of element 6 which here includes two distinct openings 18 and 19 giving access respectively to the first hole 11 and the second hole 17 pierced in catch 9. In certain circumstances this alternative embodiment may facilitate introduction of the hook into the desired hole.

If one now returns to FIG. 1, it will be seen that to the first element 1, in addition to the end 2 of bracelet 3 a first arm 20 is attached and that to the second element 6 in addition to the end 7 of bracelet 3, a second arm 21 is attached. The free ends of arms 20 and 21 are united by means of a hinge 22. Here one is concerned with a folding buckle type clasp, such buckle being well known in the state of the art. In order that this type of clasp may be matched to the length adjustment which comprises the main objective of this invention, it is necessary that one of the arms 20 or 21 may be shortened or lengthened according to whether hook 4 is introduced respectively in the first or the second hole borne by the catch.

The solution adopted in FIG. 1 consists of rendering the second arm 21 adjustable. The arm includes a first blade 23, one of the ends of which bears the hinge 22 and a second blade 24 provided with opposed slideways 25 in which is engaged the first blade 23. The second blade 24 is attached to the second element 6. In order to limit the travel of one blade relative to the other there has been provided an arrangement including a screw 26 with a nut, the latter being engaged in a groove 27, the length of which is limited.

It is evident that the clasp of the invention is not limited to the employment of a folding clasp formed by arms 20 and 21. Elements 1 and 6 could be simply attached to the ends of the bracelet, such bracelet being of any type whatsoever formed for instance of links or even realized in leather.

What is claimed is:

1. A bracelet clasp including a first element attached to one end of the bracelet and a second element attached to the other end of the bracelet the longitudinal extent of said bracelet between said ends defining a longitudinal direction, the first and second elements cooperating to assure latching of the clasp by superposition of said elements, the first element bearing a hook provided with a beak directed perpendicular to the longitudinal direction of the bracelet and the second element being pierced with at least one opening into which the hook may be introduced, a catch being captively mounted under the second element and slidable relative thereto in a direction perpendicular to said longitudinal direction, the catch exhibiting a portion emerging laterally from said second element in a direction perpendicular to said longitudinal direction under the return force of a spring, said portion serving as a push button adapted to be operated by a finger so as to displace the catch against the spring action, said catch being provided with a first hole partially set off relative to the opening in the second element so that when the hook is introduced into the opening of the second element it then engages with said first hole of the catch so as to displace said catch gradually against the action of the spring until the beak of the hook passes under the catch and latches the first element to the second element, said catch being displacable by finger pressure on the push button so as to align said opening with said first hole thus to permit opening of the clasp, and said catch being provided with a second hole identical with the first hole and placed therebeside in the longitudinal sense of the bracelet, the hook thus being capable of introduction into the first or the second hole in accordance with whether the bracelet is to embrace tightly or loosely the member bearing it.

2. A bracelet clasp as set forth in claim 1 wherein the second element includes a single opening giving access to the first and second holes borne by the catch.

3. A bracelet clasp as set forth in claim 1 wherein the second element includes first and second openings arranged side by side, said first and second openings giving access respectively to the first and second holes borne by the catch.

4. A bracelet clasp as set forth in claim 1 wherein the first and second elements are attached respectively to first and second arms the free ends of which are coupled together by means of a hinge, one of said arms being shaped in a manner such that its length may be varied according to whether the hook borne by the first element is introduced into the first or the second hole borne by the catch.

5. A bracelet clasp as set forth in claim 4 wherein the second arm includes a first blade one end of which bears said hinge and a second blade provided with opposed slideways wih which said first blade engages, said second blade being attached to said second element, said first and second blades being provided with an arrangement limiting the travel of said blades relative to one another.

* * * * *